US008056486B2

(12) United States Patent
Haymond et al.

(10) Patent No.: US 8,056,486 B2
(45) Date of Patent: Nov. 15, 2011

(54) RAILROAD HOPPER CAR HATCH COVER

(75) Inventors: Bradley J. Haymond, Aurora, IL (US); William P. O'Donnell, Aurora, IL (US)

(73) Assignee: Miner Enterprises, Inc., Geneva, IL (US)

( * ) Notice: Subject to any disclaimer, the term of this patent is extended or adjusted under 35 U.S.C. 154(b) by 286 days.

(21) Appl. No.: 12/384,929

(22) Filed: Apr. 10, 2009

(65) Prior Publication Data

US 2010/0258032 A1 Oct. 14, 2010

(51) Int. Cl.
*B61D 39/00* (2006.01)

(52) U.S. Cl. ..... 105/377.07; 105/377.08

(58) Field of Classification Search ..... 105/355, 105/358, 377.01, 377.05, 377.07, 377.08, 105/377.1, 377.11
See application file for complete search history.

(56) References Cited

U.S. PATENT DOCUMENTS

| | | | |
|---|---|---|---|
| 2,607,302 | A | 8/1952 | Nystrom |
| 2,652,787 | A | 9/1953 | Keleher |
| 3,126,591 | A | 3/1964 | Hamilton |
| 3,250,233 | A | 5/1966 | Carney et al. |
| 3,259,078 | A | 7/1966 | Radey et al. |
| 3,266,440 | A | 8/1966 | Price et al. |
| 3,307,498 | A | 3/1967 | Stevens |
| 3,523,506 | A | 8/1970 | Williams |
| 4,239,008 | A | 12/1980 | Conlon |
| 4,368,674 | A | 1/1983 | Wiens et al. |
| 4,452,150 | A | 6/1984 | Dominguez |
| 4,602,569 | A | 7/1986 | Kleykamp |
| 4,635,979 | A | 1/1987 | Blume |
| 4,638,743 | A | 1/1987 | Loomis |
| 4,796,538 | A | 1/1989 | McLean et al. |
| 4,840,126 | A | 6/1989 | Kleykamp |
| 4,978,582 | A | 12/1990 | Stamm et al. |
| 4,998,642 | A | 3/1991 | Kraus |
| 5,266,143 | A | 11/1993 | Albera et al. |
| 5,355,808 | A | 10/1994 | Early |
| 5,622,117 | A | 4/1997 | Burian et al. |
| RE35,949 | E | 11/1998 | Early |

(Continued)

OTHER PUBLICATIONS

International Searching Authority/USPTO; International Search Report regarding PCT/US2010/000284; Apr. 28, 2010; 2 pages.
International Searching Authority/USPTO; Written Opinion of the International Searching Authority regarding PCT/US2010/000284; Apr. 28, 2010; 6 pages.

(Continued)

*Primary Examiner* — Joe Morano, IV
*Assistant Examiner* — R. J. McCarry, Jr.
(74) *Attorney, Agent, or Firm* — Law Office of John W. Harbst

(57) ABSTRACT

A railroad car hatch cover including a high strength and highly rigid laminate panel having an inner aluminum member, an outer aluminum member, and a solid plastic core. A cross-section of the laminate panel includes a center section with two generally parallel and generally vertical sides. Each generally vertical side of the panel is joined to center section of the panel along a longitudinally elongated curved corner having a radius of less than 1.5 inches. Moreover, compressible gasket structure is secured to an underside of the center section of the laminate panel in the vicinity of each corner for engaging and pressing against a top rim of railcar coaming to seal the hatch cover whereby inhibiting contaminants from passing between the closed clover and the coaming on the railcar. Additionally, the laminate panel is provided with longitudinally spaced structure, arranged inwardly from the opposed ends of and secured across the laminate panel, for adding further strength and rigidity to the hatch cover.

24 Claims, 7 Drawing Sheets

U.S. PATENT DOCUMENTS

| | | | | |
|---|---|---|---|---|
| 6,085,664 | A | 7/2000 | early | |
| 6,199,939 | B1 | 3/2001 | Ehrlich | |
| 6,205,943 | B1 | 3/2001 | Lonno et al. | |
| 6,220,651 | B1 | 4/2001 | Ehrlich | |
| 6,412,854 | B2 | 7/2002 | Ehrlich | |
| 6,494,338 | B1 | 12/2002 | Schultz | |
| 6,827,025 | B2 * | 12/2004 | Gaydos et al. | 105/377.07 |

OTHER PUBLICATIONS

Association of American Railroads Mechanical Division; Manual of Standards and Recommended Practices; Trough Hatch Cover Acceptance Specification Standard S-2037-92; Adopted: 1984 Revised: 1986, 1992; pp. C-263 through C-270.2.

* cited by examiner

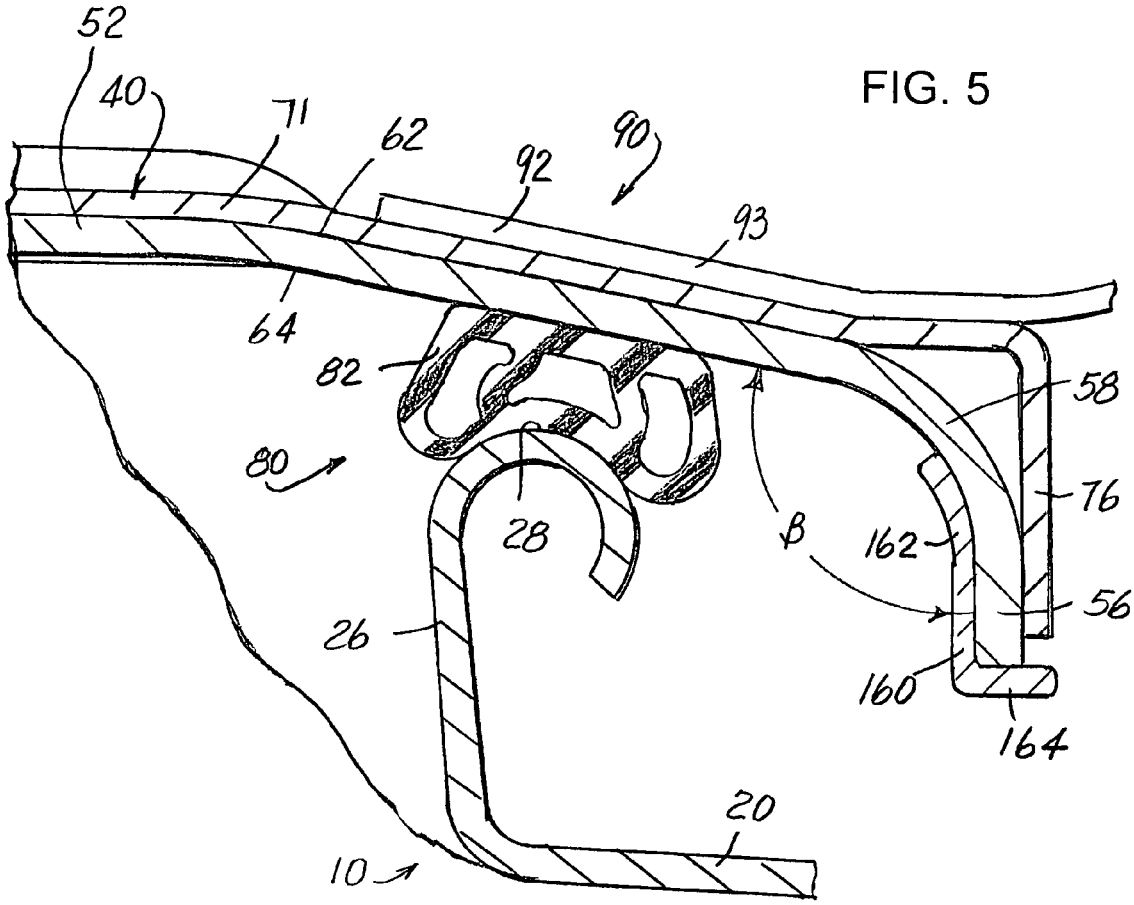
FIG. 5
FIG. 6
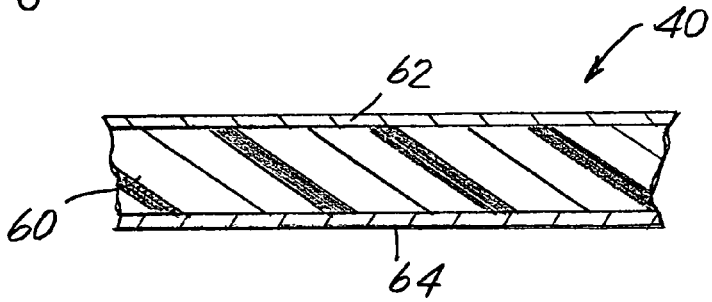

RAILROAD HOPPER CAR HATCH COVER

FIELD OF THE INVENTION DISCLOSURE

The present invention generally relates to railroad hopper cars and, more particularly, to a improved hatch cover for releasably closing a hatch opening in a roof of a railroad hopper car.

BACKGROUND

Railroad hopper cars have been used for years to transport particulate and granular material such as grain and the like. Covered railroad hopper cars have been constructed and arranged with a roof for protecting the railcar contents from contaminants and weather related elements. Access to an interior of the railcar from above is through a hatch opening in the roof of the railcar. One type of railcar in wide spread use presents a hatch opening typically extending the length of the railcar. In some railcar designs, the hatch opening can be configured with arcuate end portions. Cowled coaming, upstanding from the roof, typically extends circumferentially or peripherally about the hatch opening.

The hatch opening in the roof of the railcar is closed during transport by a series of individual hatch covers typically arranged in end-to-end relationship relative to each other. The hatch covers are usually pivotally connected to the roof along one side thereof and can be swung to an open position. In one form, each hatch cover can measure in length from eight to thirteen feet and weigh approximately 100 pounds. Suffice it to say, the hatch covers are sized to extend across and over a top rim of the coaming to cover the hatch opening. Typically, the hatch covers are secured in a closed position during transport by a series of batten bars and hold downs.

Known hatch covers used to close hatch openings in covered hopper cars suffer from numerous problems. One form of known hatch cover is formed of fiberglass or other suitable moldable material. Fiberglass hatch covers, however, are susceptible to deteriorating ultraviolet rays as well as weather related deterioration factors. Fiberglass hatch covers must be designed and manufactured with reinforced profiles for accommodating mounting of several hinge structures along the length thereof to allow pivotal movement of the hatch cover between open and closed positions. As will be appreciated, the need for reinforced profiles adds to the complexity of the hatch cover design. Moreover, the need for high temperatures and pressures in the hatch cover molding process leads to relatively high cost and other obvious problems. Additionally, the molding compound does not readily flow into deep ribs, bosses and related reinforcement areas of the hatch cover. Accordingly, reduced reinforcement and a decreased stiffening effect often results from imperfect formation of the hatch cover.

Although specifically directed not to walk across or stand on such railcar hatch covers, it is inevitable workers tend to stand or walk across the closed hatch covers as commodity is added or loaded into the railcar. Accordingly, hatch covers have typically been structurally designed with a "hat" section profile as an attempt to add strength and stiffness to the hatch cover. As will be appreciated, requiring such a profile adds to the complexity of the hatch cover design along with manufacturing process and, again, adds to the overall cost of the hatch cover. Moreover, the need for such a profile to accomplish rigidity and stiffness increases the weight of the hatch cover whereby detracting from the overall carrying capacity of the railcar.

Additionally, known railcar hatch covers typically include generally vertical sidewall structure arranged on opposite lateral sides of the longitudinal centerline of the hatch cover and which depend from a center section of the hatch cover. Each depending sidewall is joined to the center section of the hatch cover. Since each depending sidewall terminates below the top rim of the coaming, the sidewalls of the hatch cover advantageously inhibit dirt and related debris from passing between the hatch cover and the top rim of the coaming.

A problem has developed in known hatch cover designs. Cracks have been known to form in the material used to form the hatch cover. In some designs, such cracks have occurred and radiated in a corner region where the generally vertical depending sides of the hatch cover are joined to the center section of the hatch cover. It appears the cracks may be formed by the concentration of stress at the corner regions of the hatch cover. Such cracks allow water, and related contaminants to leak through the hatch cover thereby damaging the contents of the railroad hopper car. This is simply unacceptable.

Moreover, the Association of American Railroads ("AAR") has developed and established standards which set forth specific and requirements for the design and development for railcar hatch covers. One such standard established by the AAR defines specific criteria for maintaining the hatch cover in a predetermined sealing relationship with the top rim of the coaming when the hatch cover closed. Hatch covers must be sufficiently rigid to qualify under this and related AAR standards. In those hatch cover designs wherein the length of the hatch cover can measure up to thirteen feet between opposite ends thereof, this standard presents difficult design challenges.

Thus, there is a continuing need and a desire for a railcar hatch cover which has a simplistic lightweight design, and offers enhanced strength and stiffness over comparable known railcar hatch covers.

SUMMARY

In view of the above, there is provided a railcar hatch cover adapted to be positioned relative to a longitudinally elongated hatch opening defined in a roof of a covered railroad hopper car. The railcar roof further includes upstanding coaming arranged in surrounding relation relative to the hatch opening. Structure is provided for mounting the hatch cover for movement between open and closed positions.

According to one aspect, the hatch cover includes a high strength and highly rigid laminate panel having longitudinally spaced ends and a centerline. The laminate panel includes an inner aluminum member, an outer aluminum member, and a solid plastic core adhered to confronting surfaces of the inner and outer aluminum members. The inner and outer aluminum members each have a grain extending longitudinally of the panel. A cross-section of the laminate panel includes a center section with two generally parallel and generally vertical sides, with one generally vertical side of the panel being laterally disposed to each side of the longitudinal centerline of and extending the length of the panel. Each generally vertical side of the panel depends from and is joined to center section of the panel along a longitudinally elongated curved corner having a radius of less than 1.5 inches. Moreover, compressible gasket structure is secured to an underside of the laminate panel for engaging and pressing against a top rim of the coaming to seal the hatch cover whereby inhibiting contaminants from passing between the closed cover and the coaming on the railcar. Additionally, the laminate panel is provided with longitudinally spaced structure, arranged inwardly from the opposed ends of and secured across the laminate panel, for adding further strength and rigidity to the hatch cover.

Preferably, one generally vertical side of the laminate panel depends from the center section a greater distance than does the other generally vertical side of the laminate panel. In one form, the center section of the laminate panel has a vaulted formation to allow the hatch cover to shed water after being secured to the railcar. Preferably, each hatch cover further includes an end cover attached to and carried by each end of the laminate panel. In one form, the end cover includes an upstanding ridge extending laterally across the end of the hatch cover, with the upstanding ridge being configured to cooperate with a batten bar to hold the hatch cover in the closed position.

According to another aspect, the hatch cover includes a laminate panel of sufficient size to cover at least a longitudinal lengthwise portion of the hatch opening. The laminate panel has longitudinally spaced ends and includes an inner aluminum member, an outer aluminum member, and a solid plastic core adhered to confronting surfaces of the inner and outer members. A cross-section of the laminate panel including a flat center section extending substantially between the ends of the panel with two generally vertical sides disposed to opposite sides of a longitudinal centerline of and extending between the ends of the panel and depending from the center section. To inhibit leaking, the center section and the generally vertical sides of the laminate panel are a continuous structure. The sides are joined to the center section along a longitudinally elongated corner. Compressible gasket structure is secured to an underside of the laminate panel for engaging and pressing against an upper rim of the coaming to seal the hatch cover in a closed position. Longitudinally spaced structure disposed inwardly from the opposed ends of and secured across the outer panel of the laminate panel adds strength and rigidity to the hatch cover.

In one form, one generally vertical side of the laminate panel depends from the center section of the panel a greater distance than does the other generally vertical side of the laminate panel. Preferably, the center section of the laminate panel has a vaulted formation to allow the hatch cover to shed water when closed. In a preferred embodiment, the railcar hatch cover further includes an end cover attached to and carried by each end of the laminate panel. Each end cover preferably includes an upstanding ridge extending laterally across the end of the hatch cover, with the upstanding ridge being configured to cooperate with a batten bar to hold the hatch cover in the closed position. To inhibit contaminants from moving past the closed hatch cover, the batten bar has compressible gasket structure nested therein for cooperatively combining with the raised ridge on the end cover when the hatch cover is in the closed position.

According to yet another aspect, the railcar hatch cover includes a laminate panel having longitudinal spaced ends and including an extruded inner member, an extruded outer member, and a solid plastic core material adhered to confronting surfaces of the inner and outer members. The laminate panel has a center section extending substantially between the ends of the panel with two generally parallel and generally vertical sides. One generally vertical side of the panel is disposed to each side of a longitudinal centerline of and extends between the ends of the panel and depends from the center section. The laminate panel has a flexural rigidity or stiffness S derived as follows:

$$S=E\times I$$

wherein "E" is the flexural modulus of the material and "I" is the Moment of Inertia of the hatch cover;

and wherein the laminate panel has an "E" value equal to $4\times10^6$ p.s.i.;

and wherein the cross-sectional configuration of the center section and two sides of the laminate panel define a Moment of Inertia for the panel such that the laminate panel has a Stiffness or flexural rigidity equal to $2.407\times10^7$ lbs.×inches$^2$. Compressible gasket structure is secured to an underside of the laminate panel for engaging and pressing against a rim of the railcar coaming to seal the hatch cover in a closed position. Longitudinally spaced structure is disposed inwardly from the opposed ends of and is secured across the outer member of the laminate panel for adding strength and rigidity to the hatch cover.

According to this aspect, the inner and outer members are extruded from aluminum and have a grain extending longitudinally of the laminate panel. Preferably, one generally vertical side of the laminate panel depends from the center section of the panel a greater distance than does the other generally vertical side of the laminate panel.

In one form, the center section of the laminate panel has a vaulted formation to allow the hatch cover to shed water when in a closed position. The hatch cover furthermore preferably includes an end cover attached to and carried by each end of the laminate panel. Each end cover preferably includes an upstanding ridge extending laterally across the end of the hatch cover, with the upstanding ridge being configured to cooperate with a batten bar to hold the hatch cover in the closed position. To retard the passage of contaminants past the closed hatch cover, the batten bar has compressible gasket structure nested therein for cooperatively combining with the raised ridge on the end cover when the hatch cover is in the closed position.

According to yet another aspect, the railcar hatch cover includes a rigid frame assembly comprised of a series of spaced and generally parallel metal support members, a pair of end pieces, and pair of longitudinally elongated rigid metal members extending substantially an entire length of each hatch cover. The metal support members and the end pieces each have a center section, and two end sections arranged in depending relation relative to the center section. In this form, the end sections of each support member and end pieces are fastened toward a distal end thereof to one of the rigid metal members. A laminate panel of sufficient size to cover at least a longitudinal lengthwise portion of said hatch opening is secured to the frame assembly. The laminate panel has longitudinally spaced ends and includes an inner aluminum member, an outer aluminum member, and a solid plastic core adhered to confronting surfaces of said inner and outer members. A cross-section of the laminate panel includes a center section and two generally vertical sides disposed to opposite sides of a longitudinal centerline of and extending between the ends of the panel and depending from the center section.

In this embodiment, one side of the laminate panel depends from the center section a greater distance than the other side of the laminate panel. Preferably, the center section of the laminate panel has a vaulted formation to allow the hatch cover to shed water. In this form, the railroad car hatch cover has a flexural rigidity S derived as follows:

$$S=E\times I$$

wherein "E" is the flexural modulus of the material and "I" is the Moment of Inertia of the hatch cover;

and wherein said laminate panel has an "E" value equal to $4\times10^6$ p.s.i.;

and wherein the cross-sectional configuration of the center section and two sides of said laminate panel define a Moment of Inertia for said panel such that said laminate panel has a flexural rigidity or Stiffness equal to $2.407\times10^7$ lbs.×inches$^2$. According to this aspect, each side of the laminate panel preferably defines an angle ranging between 80° and about 115° relative to the center section and is joined to the center section of the panel along a longitudinally elongated curved corner section having a radius of less than 1.5 inches.

DETAILED DESCRIPTION OF THE DRAWINGS

FIG. 5 is an enlarged fragmentary sectional view taken along line 5-5 of FIG. 1;

FIG. 6 is an enlarged fragmentary cross-sectional view of a laminate panel forming part of this invention disclosure;

DETAILED DESCRIPTION

Figure 1:
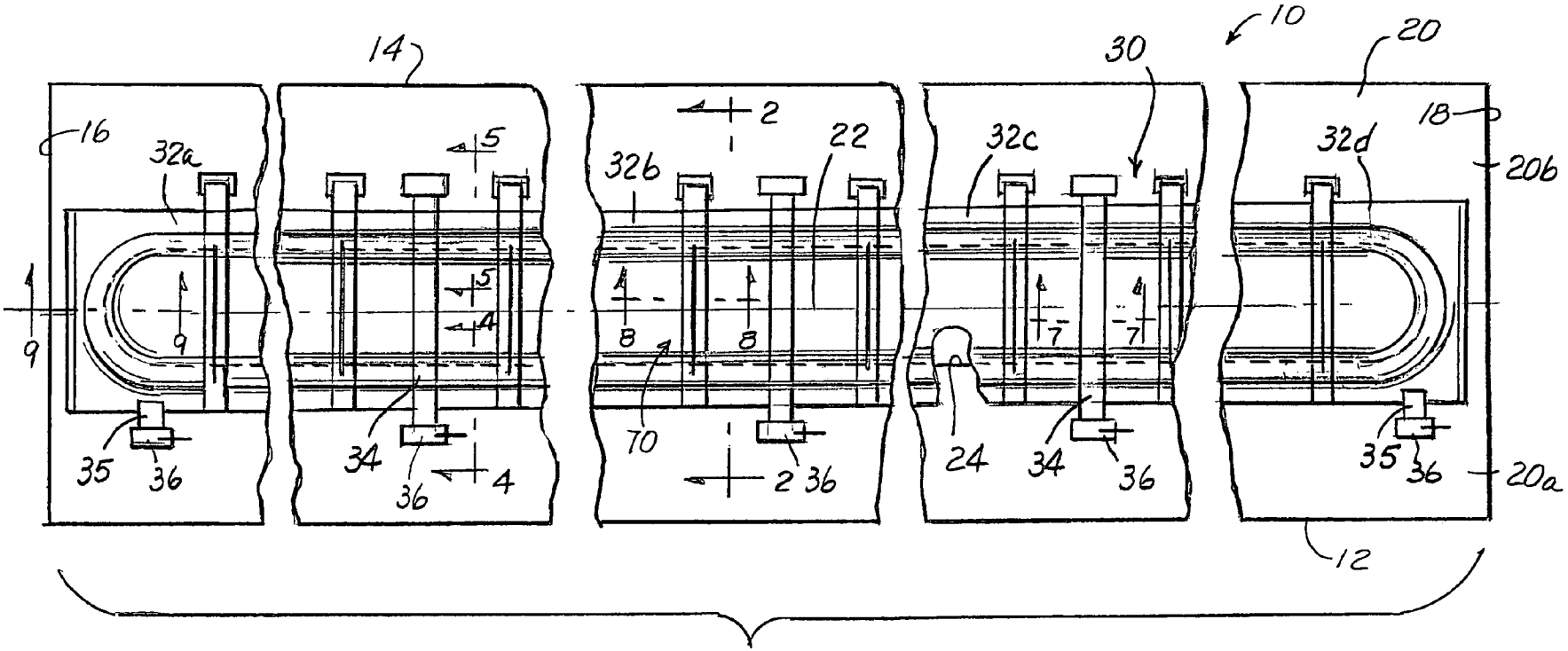
FIG. 1 is a top plan view, partially broken away, of a railroad hopper car illustrating a hatch cover assembly carried on a roof of the railcar and embodying principals of this invention disclosure.

While this disclosure is susceptible of embodiment in multiple forms, there is shown in the drawings and will hereinafter be described a preferred embodiment of the disclosure, with the understanding the present disclosure sets forth an exemplification which is not intended to limit the invention disclosure to the specific embodiment illustrated and described.

Referring now to the drawings wherein like reference numeral indicate like parts through the several views, in FIG. 1 there is shown a covered railroad hopper car which embodies features of the present invention disclosure and which is generally referenced by numeral 10. Railcar 10 has a conventional box-like strong and rigid structure including a pair of longitudinally extending and laterally spaced sidewalls 12 and 14, a pair of laterally extending and longitudinally spaced upstanding end walls 16 and 18, and a roof 20. In one form, roof 20 includes a pair of longitudinally extending roof sheets 20*a* and 20*b* disposed laterally to opposite lateral sides of a longitudinal centerline 22 of railcar 10. In the illustrated form, the roof sheets 20*a* and 20*b* slope laterally and downwardly in opposite directions from the centerline 22 and toward the respective sidewalls 12 and 14 of the railcar 10. Railcar 10 is adapted for the transportation of granular materials or commodity and has a conventional bottom (not shown) which is configured with a plurality of outlets for allowing the granular material or commodity to be discharged from car 10.

In the illustrated embodiment, railcar 10 has an elongated and longitudinally extending hatch opening 24 defined toward a central portion of the roof 20 for loading granular materials or commodity into the car 10. The hatch opening 24 is generally centralized with respect to the longitudinal centerline 22 of the car 10. In one form, the hatch opening 24 has a generally rectangular configuration between opposed ends thereof.

Figure 2:
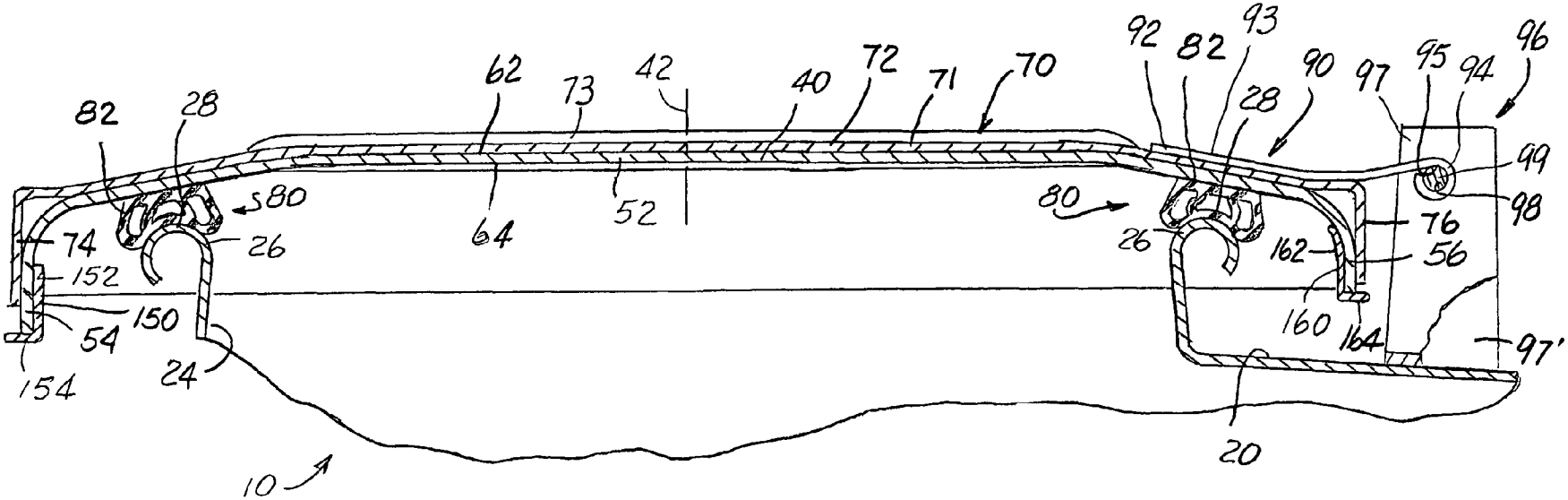
FIG. 2 is a cross-sectional view taken along line 2-2 of FIG. 1.

Turning to FIG. 2, and as is conventional, the hatch opening 24 has coaming 26 extending about a periphery thereof. The coaming 26 is of water-tight construction and is secured in water-tight upstanding relation relative to the roof 20. As shown, the coaming 26 preferably terminates in a rolled edge or tip 28.

Returning to FIG. 1, and to protect the materials or commodity being transported within car 10, the hatch opening 24 is covered by a hatch cover assembly 30. In one form, cover assembly 30 is comprised of a series of longitudinally elongated and generally aligned hatch covers 32*a*, 32*b*, 32*c*, and 32*d* arranged in end-to-end relation relative to each other. As will be appreciated, the hatch cover assembly 30 can include more or fewer hatch covers than shown in the exemplary embodiment without detracting or departing from the spirit and scope of the novel concept set forth by the present invention disclosure. In the illustrated embodiment, hatch covers 32*a* and 32*d* serve as end hatch covers while hatch covers 32*b* and 32*c* serve as intermediary hatch covers. Suffice it to say, the cumulative lengths of the hatch covers 32*a*, 32*b*, 32*c* and 32*d* are sufficient to cover and close the hatch opening 24 on car 10.

In the illustrated embodiment, the covers 32*a* through 32*d* are movable between open and closed positions relative to the hatch opening 24 on railcar 10. In one form, the hatch covers 32*a* through 32*d* are removably maintained in a closed position by a series of conventional batten bars 34 and hold downs 35. As known, each batten bar 34 is pivotally secured toward one end thereof to the roof 20 and extends across end regions of the hatch covers. An opposite end of each batten bar 34 is releasably secured to the roof 20 by a conventional latch structure 36. In the illustrated embodiment, the latch structure 36 for releasably securing the batten bar 34 to the roof 20 can be similar to that disclosed in U.S. Pat. No. 4,635,979 to O. E. Blume; the applicable portions of which are incorporated herein by reference. As will be discussed below, each batten bar 34 is constructed such that, when secured in place, the batten bars 34 inhibit debris and related contaminants, including the elements of weather, from passing between the confronting and preferably abutting ends of the respective covers. In one form, each hold down 35 extends from the side of the hatch cover opposite that side allowing for pivotal movement of the hatch cover and can be arranged in operable combination with conventional latch structure 36 for releasably holding the hatch cover in a closed position.

Figure 3:
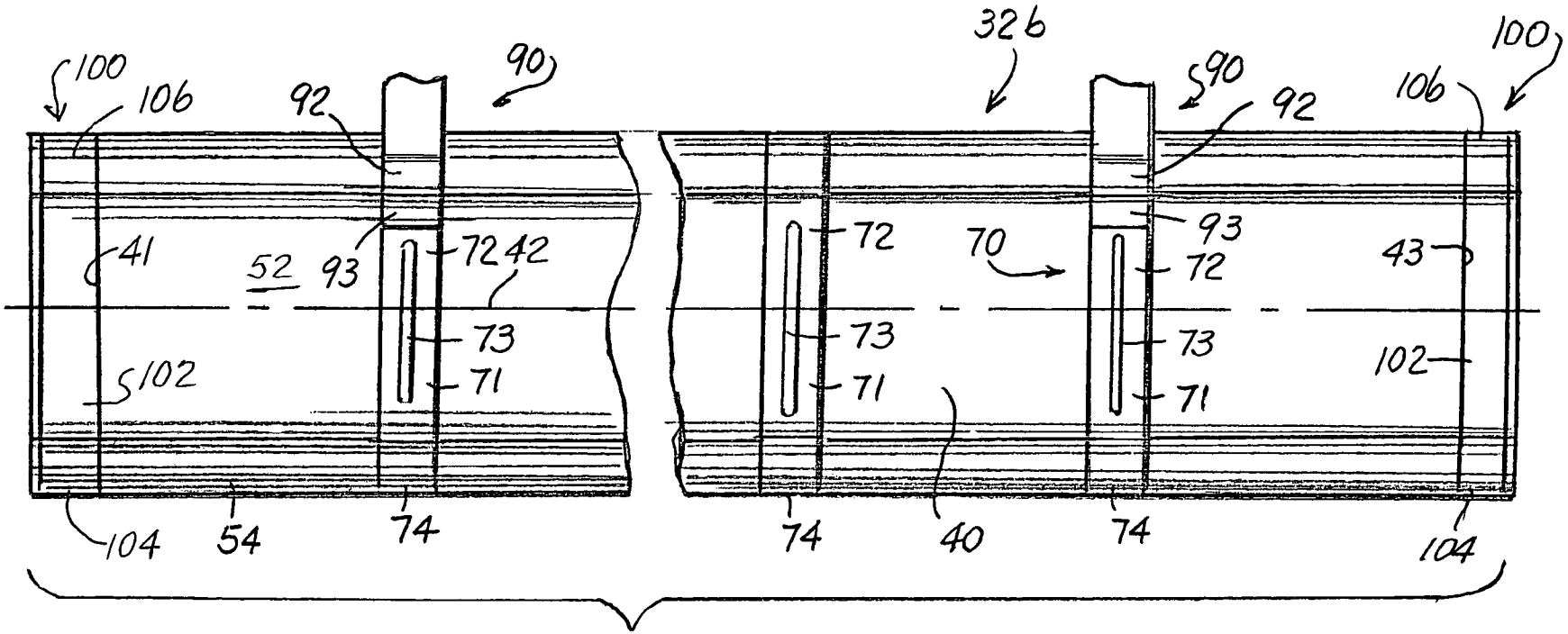
FIG. 3 is an enlarged top plan view of a railcar hatch cover embodying principals of this invention disclosure.

FIG. 3 illustrates an enlarged top plan view of hatch cover 32*b*, which, except as described below, is illustrative of each hatch cover 32*a* through 32*d*. Each hatch cover of the present disclosure includes a high strength and highly rigid laminate panel 40 having longitudinally spaced and axially aligned ends 41 and 43 (FIG. 3) and a longitudinal centerline 42. Returning to FIG. 2, the laminated panel 40 of each hatch cover includes a center section 52 extending substantially the entire length of panel 40 and two generally vertical side sections or skirts 54 and 56 disposed to opposed sides of the longitudinal centerline 42 and integrally formed with the center section 52 so as to inhibit the hatch cover from leaking when exposed to the weather elements. Preferably, the center section 52 of panel 40 preferably has a vaulted formation to allow the hatch cover to shed water when installed in the railcar 10.

Figure 4:
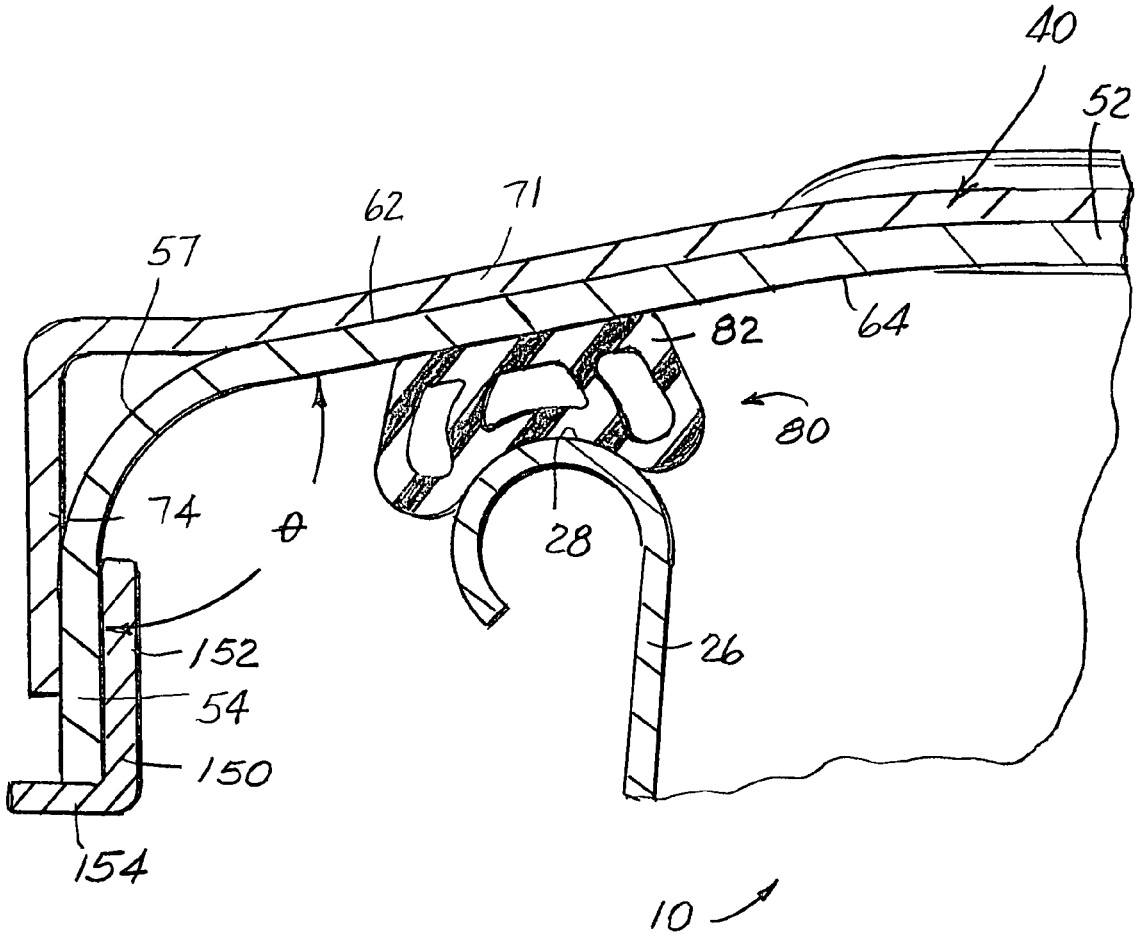
FIG. 4 is an enlarged fragmentary sectional view taken along line 4-4 of FIG. 1.

As shown in FIG. 4, the side section or skirt 54 of each panel 40 depends from the center section 52 at a predetermined angle θ. In one form, the angle θ ranges between about 80° and about 120° relative to the center section 52. In a most preferred form, the side section or skirt 54 of each panel 40 depends from the center section 52 at an angle of about 90° relative to the center section 52. In the embodiment illustrated in FIG. 4, the side section 54 of panel 40 is joined to the center section 52 along a corner section 57 extending longitudinally and substantially the entire length of the panel 40.

In the embodiment illustrated in FIG. 5, the side section or skirt 56 of each panel 40 depends from the center section 52 at a predetermined angle β. In one form, the angle β ranges between about 80° and about 120° relative to the center section 52. In a most preferred form, the side section or skirt 56 of each panel 40 depends from the center section 52 at an angle of about 90° relative to the center section 52. As shown, the side section 56 is joined to the center section 52 of panel 40 along a corner section 58 extending longitudinally and substantially the entire length of the panel 40. As shown in FIG. 2, and as discussed below, the vertical side section 54 of panel 40 depends from the center section 52 a greater vertical distance than does the vertical side section 56. Suffice it to say, however, the cross-sectional profile of each hatch cover 32*a* through 32*d* satisfies AAR specifications.

Turning to FIG. 6, the laminate panel 40 includes a core member 60 sandwiched between an outer thin and preferably aluminum skin 62 and an inner thin and preferably aluminum skin 64. Core member 60 is bonded or otherwise attached to the skins 62 and 64 by a suitable well known adhesive or other like means. As shown in FIG. 2, the outer skin 62 faces toward the outside of the car 10 which is exposed to the elements while inner skin 64 faces toward an interior of the railcar 10. In one form, both major surfaces on the outer and inner skins 62 and 64, respectively, are suitably treated, i.e., powder coated or otherwise finished. Moreover, a suitable treatment for enhancing traction for workers can be added to the outer surface of the center section 52. Preferably, core member 60 is made from a solid non-metal material, such as plastic or the like. The materials included in the laminate panel 40 are relatively inexpensive as compared to a conventional solid aluminum hatch cover construction. Additionally, and because a composite panel is used for each hatch cover 32*a* through 32*d*, the overall weight of each hatch cover is reduced as compared to conventional hatch covers.

The aluminum skins 62 and 64 add strength, stiffness and rigidity to each hatch cover 32*a* through 32*d* while their minimal thickness significantly reduces the weight of the each hatch cover. In one form, the skins 62 and 64 are each approximately 0.02 inches thick. The cumulative thickness of the skins 62, 64 and core 60 measures about 0.236 inches.

As shown in FIG. 4, and in contrast to accepted teachings regarding aluminum, the corner section 57 joining the side section 54 to the center section 52 of panel 40 forms an arcuate surface having a radius equal to or less than 1.5 inches without causing cracking or longitudinal splitting of the outer surface of outer skin 62. As shown in FIG. 5, and in contrast to accepted teachings regarding aluminum, the corner section 58 joining the side section 56 to the center section 52 of panel 40 forms an arcuate surface having a radius equal to or less than 1.5 inches without causing cracking or longitudinal splitting of the outer surface of outer skin 62.

Preferably, the laminate panel 40 for each hatch cover is formed using a stamping process. In a most preferred form, the laminate panel 40 of each hatch cover is formed as a result of a one-step stamping process.

The cross-sectional configuration of the panel 40 has been designed whereby allowing each hatch cover to pass the stringent AAR standards established for railcar hatch covers. More specifically, each hatch cover has a flexural rigidity or stiffness S derived as follows:

$$S=E\times I$$

wherein "E" is the flexural modulus of the material and "I" is the Moment of Inertia of each hatch cover;

and wherein the laminate panel 40 has an "E" value equal to $4\times10^6$ p.s.i.;

and wherein the cross-sectional configuration of the center section 52 and two generally vertical side section 52 and 54 of the laminate panel define a Moment of Inertia for the panel 40 such that the laminate panel has a flexural rigidity of $2.407\times10^7$ lbs.×inches$^2$.

As shown in FIGS. 1 and 3, each hatch cover further includes longitudinally spaced structure 70 disposed inwardly from the opposed ends 41 and 43 of each panel 40 for adding further strength and rigidity to the hatch cover. As shown in FIG. 3, structure 70 is preferably comprised of a plurality of rigid one-piece metal straps 71 which are longitudinally spaced from each other between the ends 41 and 43 of each hatch cover. Preferably, and to reduce costs, the straps are substantially similar to each other. Accordingly, only one strap 71 needs to be described in detail for an understanding of structure 70.

Figure 7:
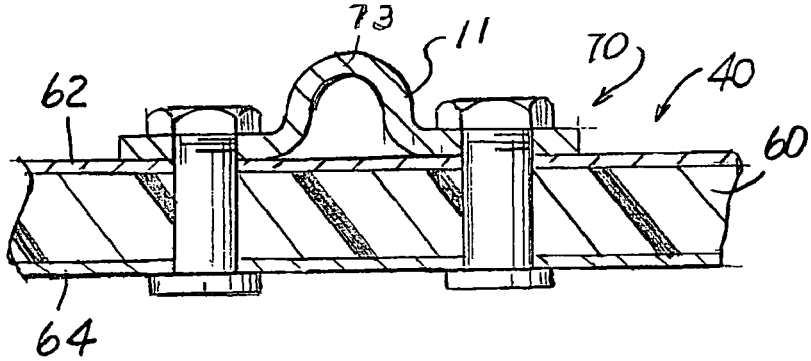
FIG. 7 is an enlarged cross-sectional view taken along line 7-7 of FIG. 1.

In the form illustrated by way of example in FIG. 2, each strap 71 generally parallels the cross-sectional configuration of the laminate panel 40 forming each hatch cover. More specifically, as and shown in FIG. 2, each metal strap 71 includes a center section 72 extending across and attached to the center section 52 of the laminate panel 40. Each strap 71 furthermore includes two side sections 74 and 76 depending from the center section 72. In one form, the side sections 74 and 76 of each strap are secured to the side sections 54 and 56, respectively, of the laminate panel 40. Each strap 71 can be secured to the laminate panel 40 of each hatch cover as through any suitable means including fasteners, adhesives, and/or both. In a preferred embodiment, and to add to the strength and rigidity of each hatch cover, each strap 71 is preferably made from steel. Moreover, and as shown in FIG. 7, each strap 71 is preferably provided with a raised rib 73 which extends lengthwise of the strap at least across the center section 72 for adding further strength and rigidity to the hatch cover.

Turning again to FIGS. 2, 4 and 5, and on an underside thereof, each hatch cover furthermore includes compressible gasket structure 80 for inhibiting contaminants and moisture (i.e, dirt, dust, snow, water, etc.) from passing between a hatch cover, arranged in a closed position, and the coaming 26 on the railcar 10. Preferably, gasket structure 80 includes a neoprene gasket 82 secured to the underside of the inner skin 64 of the panel 40 at a location to effect a tight seal against the rolled rim 28 of coaming 26 when the respective hatch cover is closed in the hopper car 10. The gasket structure 80 deforms about the rim 28 of coaming 26 to provide a tight seal when the hatch cover is closed whereby preventing moisture and other foreign material from contaminating the granular materials or commodity contents of the car 10.

Each hatch cover forming hatch cover assembly 30 (FIG. 1) is mounted to the roof 20 of railcar 10 (FIG. 1) for pivotal movements between open and closed positions by hinge structure 90. In one form, hinge structure 90 includes a plurality of hinge plates 92 (with only one being shown in FIG. 2) pivotally connecting each hatch cover to the hopper car 10 (FIG. 1). The side section 56 of the laminate panel 40 disposed closest to the hinges is shorter in length than the depending side section 54 so as to not interfere with pivoting movement of the hatch cover between closed and open positions. Suffice it to say, the depending side section 56 has a length sufficient to inhibit contaminants from passing thereunder toward the gasket structure 80.

With continued reference to FIG. 2, each hinge plate 92 includes a generally flat web portion 93 which is configured to generally correspond with at least that lengthwise portion of the metal strap 71 extending toward the side section or skirt 56 of the laminate panel 40. In the illustrated embodiment, and to reduce stress on the laminate panel 40, the generally flat web portion 93 of each hinge plate 92 is secured as with fasteners, and/or adhesives to the metal strap 71. As shown, a lengthwise portion of each hinge plate 92 extends laterally outwardly from and generally normal to the side section or skirt 56 of the laminate panel 40. Each hinge plate 92 is preferably fabricated from cold rolled steel or other suitable material.

In the embodiment shown in FIG. 2, a free or distal end of each hinge plate 92 is rolled or otherwise configured with a hinge barrel portion 94 defining a bore 95 extending therethrough. Of course, the hinge barrel portion 94 can be formed as an integral part of the hinge plate 92 (as shown in FIG. 2) or as a separate piece attached thereto without detracting or departing from the spirit and scope of the present disclosure. Moreover, the roof 20 of the hopper car is typically equipped or provided with spaced sets of hinge brackets 96. Each hinge bracket 96 includes generally parallel and spaced arms 97, 97' which, in one form, embrace the distal end of the hinge plate 92 and which project upwardly from the roof 20. The arms 97, 97' of each hinge bracket 96 present axially aligned openings 98 with which the bore 95 in the hinge plate 92 generally aligns. A hinge pin 99 can be inserted through the openings 98 in the hinge bracket 96 and the bore 95 defined by the hinge plate 92 to pivotally mount the hatch cover on the hopper car for opening and closing pivoting movements about the generally horizontal axis defined by the hinge pin 99.

Preferably, each hatch cover 32*a* through 32*d* has two end pieces operably associated therewith. So as to reduce costs, the end pieces associated with opposed ends of each of the intermediate hatch covers 32*b* and 32*c* are substantially identical relative to each other. The end pieces associated with the intermediate hatch covers 32*a* through 32*d* will be generally referred to be reference numeral 100. Since the end pieces 100 associated with the intermediate hatch covers are substantially identical only the end piece 100 associated with hatch cover 32*b* will be discussed in detail.

Figure 8:
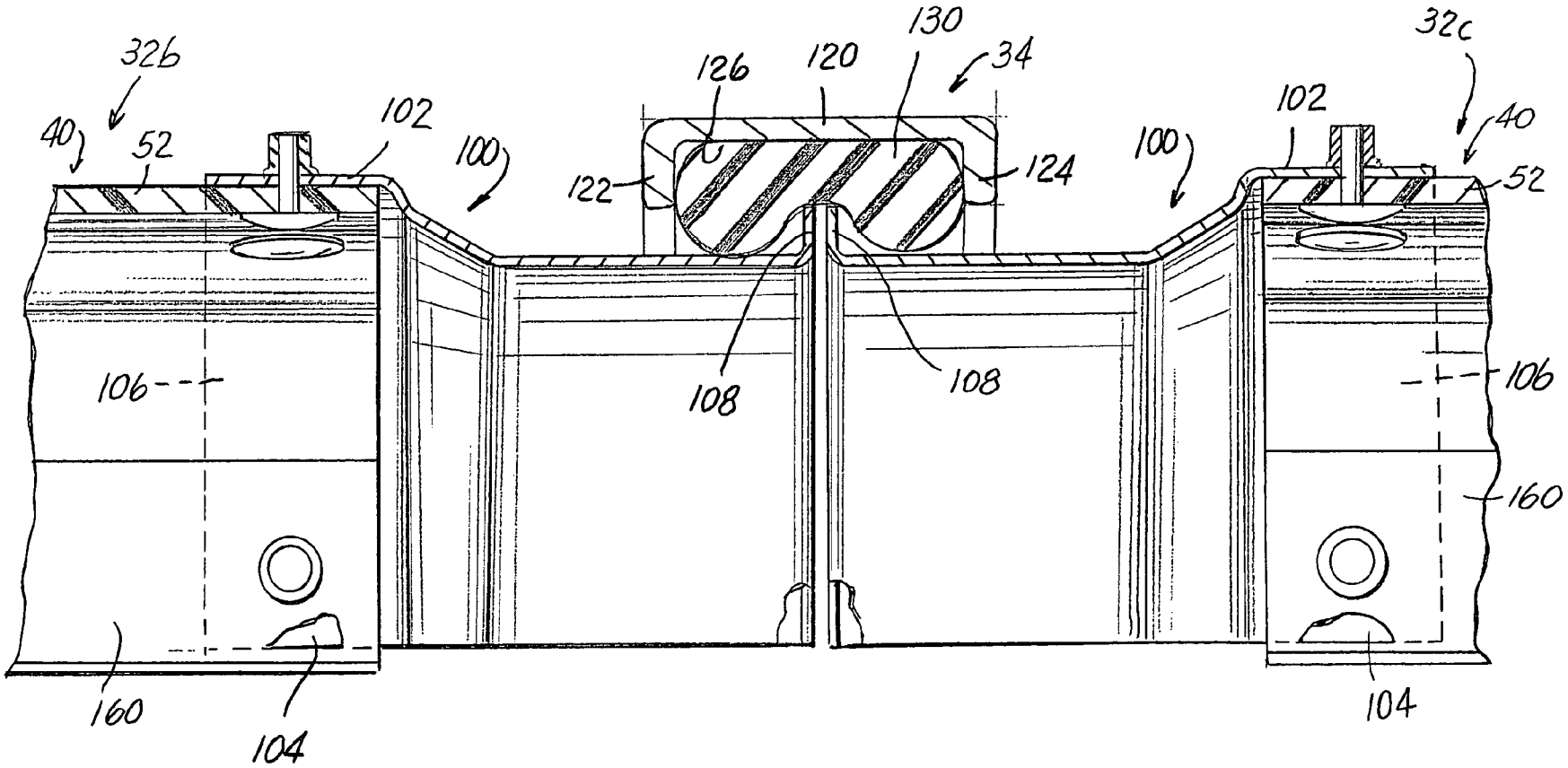
FIG. 8 is an enlarged cross-sectional view taken along line 8-8 of FIG. 1.

As illustrated FIG. 8, the end piece 100 at each end of the intermediate hatch covers is preferably fabricated from metal and is carried by and moves with the hatch cover. In the illustrated embodiment, each end piece 100 is secured, as with fasteners and/or adhesive and the like. Each end piece 100 includes a center section 102 and depending side sections 104 and 106. Suffice it to say, at that end connected to the laminate panel 40, the end pieces 100 have a cross-sectional configuration or profile generally corresponding to that of the laminate panel 40. Along that edge opposite from where it is secured to the laminate panel 40, end piece 100 includes upstanding ridge structure 108 that extends across at least the center section 52 and preferably all the end of the laminate panel 40. In the embodiment illustrated by way of example in FIG. 8, when adjacent hatch covers are in a closed position, the ridge structure 108 on the end pieces 100 of adjacent hatch covers are disposed in generally proximate relation relative to each other.

In the embodiment illustrated by way of example in FIG. 8, each batten bar 34 is integrally formed with a cross-member 120 with a pair of generally parallel spaced arms 122 and 124 depending therefrom. As shown, the cross-member 120 combines with the arms 122 and 124 to define an inverted and generally U-shaped channel 126 extending all or substantially the entire length of the batten bar 34. Notably, the batten bar 34 has a cross-sectional and operative profile which closely parallels the cross-sectional and operative profile of the laminate panel 40. Moreover, each batten bar 34 furthermore includes a resilient sealing gasket 130 carried within and spanning substantially the width of the channel 126.

FIG. 8 illustrates two longitudinally adjacent intermediate hatch covers in a closed position with the batten bar positioned in operable engagement with the two longitudinally adjacent hatch covers. More specifically, FIG. 8 illustrates a centralized portion of the gasket 130 engaging the upstanding ridge structure 108 on each end piece 100 operably associated with longitudinally adjacent ends of the hatch covers. As the batten bar 34 is moved to maintain the hatch covers in a closed position, the ridge structure 108 on the adjacent ends of the hatch covers engages and seals against the gasket 130 whereby enhancing sealing of the hatch covers and, thus, inhibiting contaminants, i.e., dirt, dust, snow, rain and other weather related elements from moving past the seal 130 into the railcar hatch opening.

Returning to FIG. 1, the hatch opening 24 can have arcuate end portion at opposed end regions thereof. In this regard, the end hatch covers 32*a* and 32*d* are configured such that the center section 52 terminates, toward one end, in an arcuate configuration. Moreover, and in the embodiment shown by way of example in FIG. 9, the gasket structure 80 is secured to the underside of the inner skin 64 of the laminate panel 40 and generally follows the arcuate configuration of the terminal end of the center section 52 so as to cooperate with the coaming 26 at a location to effect a tight seal against the rolled rim 28 of coaming 26 when the respective end hatch cover is closed in the hopper car 10. The gasket structure 80 deforms about the rim 28 of coaming 26 to provide a tight seal when the hatch cover is closed whereby preventing moisture and other foreign material from contaminating the granular materials or commodity contents of the car 10. Each end hatch cover 32*a* and 32*d* is preferably provided with a transition section 53 (FIG. 9), extending both longitudinally and radially beyond the end region of the hatch opening and, in one form, preferably lowers the profile of the hatch cover toward the end thereof.

Figure 9:
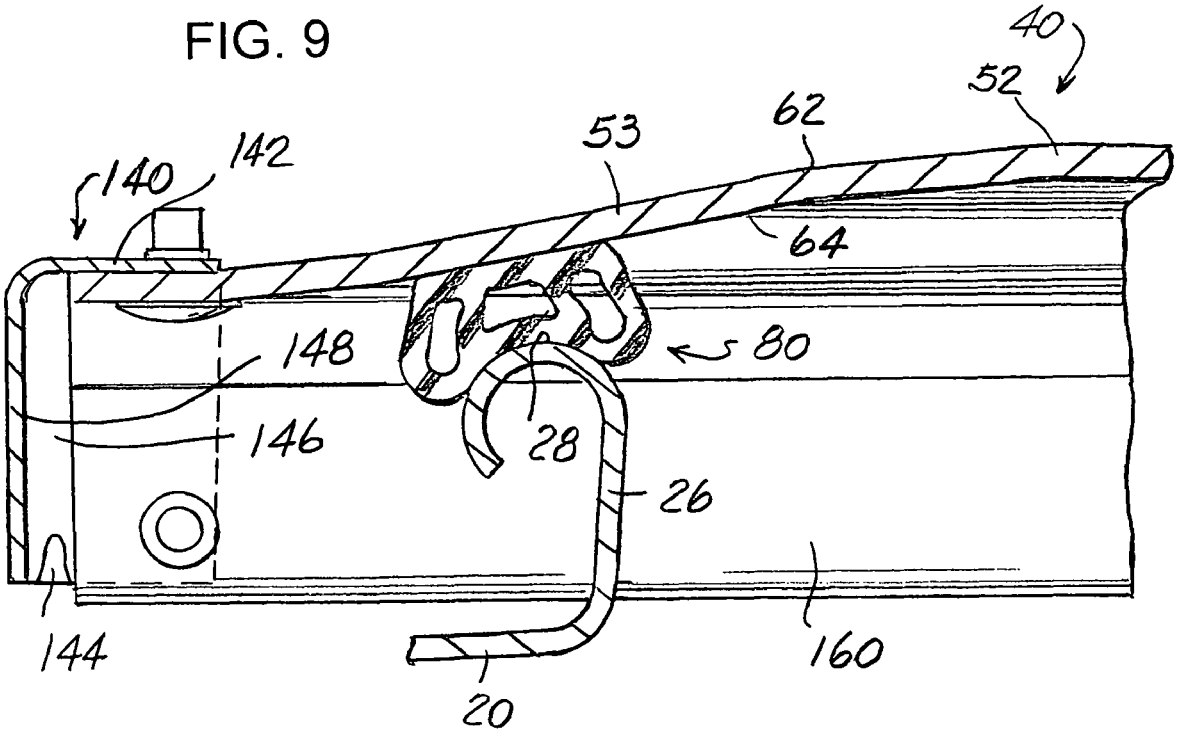
FIG. 9 is an enlarged cross-sectional view taken along 9-9 of FIG. 1.

As shown in FIG. 9, a terminal end of each end hatch cover having no adjoining hatch cover arranged in a longitudinally adjacent relationship therewith is preferably provided with another form of end piece. The end piece associated with that end of the end hatch cover having no adjoining hatch cover arranged in a longitudinally adjacent relationship therewith is generally referred to herein by reference numeral 140. Each end piece 140 is preferably fabricated from metal and is carried by and moves with the respective end hatch cover. In the illustrated embodiment, end piece 140 is secured, as with fasteners and/or adhesive to the panel 40. To further reduce costs, the end pieces 140 at the terminal end of each end hatch cover having no adjoining hatch cover arranged in a longitudinally adjacent relationship therewith are of generally similar configuration. Accordingly, only one end piece 140 will be described in detail.

Each end piece 140 includes a center section 142 and depending side sections 144 and 146. Unlike the end pieces 100 secured to the intermediate hatch covers 32*b* and 32*c*, however, the end piece 140 is preferably provided with a simple and generally flat plate-like configuration 148 which preferably follows the cross-sectional configuration or profile at the open or terminal end of the laminate panel 40 and effectively closes the open end of the end hatch cover in a manner inhibiting substantial quantities of contaminants, i.e., dust, dirt and related debris from moving therepast toward the gasket structure 80 and into the railcar 10.

In a preferred form, each hatch cover 32*a* through 32*d* furthermore includes a rigid frame structure comprised of the end pieces arranged at the ends of the hatch covers along with structure 70 including the plurality of metal straps 71. Toward their lower or distal ends, the side sections 104, 106 and 144, 146 of the end pieces 100 and 140 (FIG. 8), respectively, along with the lower or distal ends of the side sections of the metal straps 71 (FIGS. 2, 4 and 5) are all secured or fastened relative to each other by a pair of elongated stiffener rails 150 and 160, extending substantially the length of each hatch cover 32*a* through 32*d*. In the illustrated embodiment, the laminate panel 40 of each hatch cover 32*a* through 32*d* is fastened and secured, as through any suitable means, i.e., adhesive, fasteners and/or both, to the rigid frame structure to add further strength and rigidity to each hatch cover.

In one form, and as shown in FIGS. 2 and 4, each stiffener rail 150/160 preferably has a generally L-shaped cross-sectional configuration. Leg portion 152 of the stiffener rail 150 longitudinally extends along an inner surface of the side section 54 of the laminate panel 40 on each hatch cover. In the illustrated embodiment, the other leg section 154 of the stiffener rail 150 preferably abuts an underside of the depending side portion 54 of the laminate panel 40 of each hatch cover. Similarly, leg portion 162 of the stiffener rail 160 longitudinally extends along an inner surface of the side section 56 of the laminate panel 40 on each hatch cover. In the illustrated embodiment, the other leg section 164 of the stiffener rail 160 preferably abuts against an underside of the depending side portion 56 of the laminate panel 40 of each hatch cover. As shown, in the illustrated embodiment, portions of the laminate panel 40 of each hatch cover are sandwiched and entrapped between the stiffener rails 150 and 160 and the distal ends of either the straps 71 or the end pieces 100, 140 of the frame assembly whereby adding strength and rigidity to each hatch cover.

From the foregoing, it will be observed that numerous modifications and variations can be made and effected without departing or detracting from the true spirit and novel concept of this invention disclosure. Moreover, it will be appreciated, this invention disclosure merely sets forth an exemplification of the invention disclosure and is not intended to limit the invention disclosure to the specific embodiment illustrated. Rather, this disclosure is intended to cover by the appended claims all such modifications and variations as fall within the spirit and scope of the claims.

What is claimed is:

1. A railcar hatch cover adapted to be positioned relative to a longitudinally elongated hatch opening defined in a roof of a railroad hopper car, with said roof further including upstanding coaming arranged in surrounding relation relative to said hatch opening and provided with a rim arranged along a top edge thereof, and structure for mounting said hatch cover for movement between a closed position with respect to said hatch opening and an open position permitting access to the car through the hatch opening, said hatch cover comprising:

a high strength and highly rigid laminate panel having longitudinally spaced ends and a centerline, said laminate panel including an inner aluminum member, an outer aluminum member, and a solid plastic core adhered to confronting surfaces of said inner and outer members, with said inner and outer aluminum members each having a grain extending longitudinally of said panel, and wherein a cross-section of said laminate panel includes a center section with two generally parallel and generally vertical sides depending from said center section, with one generally vertical side of said laminate panel being laterally disposed to each side of the longitudinal centerline of and extending substantially the entire length of said panel, and with each generally vertical side of said panel defining an angle ranging between 80° and about 115° relative to said center section and which is joined to the center section of the panel along a longitudinally elongated curved corner section having a radius of less than about 1.5 inches;

compressible gasket structure secured to an underside of the center section of said laminate panel for engaging and pressing against the rim of said coaming to seal said hatch cover; and longitudinally spaced structure disposed inwardly from the opposed ends of and secured across said laminate panel for adding further strength and rigidity to the hatch cover.

2. The railcar hatch cover according to claim 1 wherein, one side of said laminate panel depends from said center section a greater distance than the other side of said laminate panel.

3. The railcar hatch cover according to claim 1 wherein the center section of said laminate panel has a vaulted formation to allow said hatch cover to shed water.

4. The railcar hatch cover according to claim 1 further including an end piece attached to and carried by each end of said laminate panel.

5. The railcar hatch cover according to claim 4 wherein said end piece includes an upstanding ridge extending laterally across the end of the hatch cover, with said upstanding ridge being configured to cooperate with a batten bar to hold said hatch cover in the closed position.

6. A hatch cover adapted to be positioned relative to a longitudinally elongated hatch opening defined in a roof of a railroad hopper car, with said roof further including upstanding coaming arranged in surrounding relation relative to said hatch opening and provided with a rim arranged along a top edge thereof, and structure for mounting said hatch cover for movement between a closed position with respect to said hatch opening and an open position permitting access to the car through the hatch opening, said hatch cover comprising:

a laminate panel of sufficient size to cover at least a longitudinal lengthwise portion of said hatch opening, said laminate panel having longitudinally spaced ends and including an inner aluminum member, an outer aluminum member, and a solid plastic core adhered to confronting surfaces of said inner and outer members, with a cross-section of said laminate panel including a center section with two generally vertical sides disposed to opposite sides of a longitudinal centerline of and extending between the ends of said panel and depending from said center section, and with each generally vertical side of said laminate panel depending from and defining an angle ranging between 80° and about 115° relative to said center section and which is joined to the center section of the panel along a longitudinally elongated curved corner section;

compressible gasket structure secured to an underside of the center section of said laminate panel for engaging and pressing against the rim of said coaming to seal said hatch cover; and longitudinally spaced structure disposed inwardly from the opposed ends of and secured across the outer member of said laminate panel for adding strength and rigidity to the hatch cover.

7. The railcar hatch cover according to claim 6 wherein, one generally vertical side of said laminate panel depends from the center section of said panel a greater distance than does the other generally vertical side of said laminate panel.

8. The railcar hatch cover according to claim 6 wherein the center section of said laminate panel has a vaulted formation to allow said hatch cover to shed water.

9. The railcar hatch cover according to claim 6 further including an end piece attached to and carried by each end of said laminate panel.

10. The railcar hatch cover according to claim 9 wherein said end piece includes an upstanding ridge extending laterally across the end of the hatch cover, with said upstanding ridge being configured to cooperate with a batten bar to hold said hatch cover in the closed position.

11. The railcar hatch cover according to claim 10 wherein said batten bar has compressible gasket structure nested therein for cooperatively combining with the raised ridge on said end piece when said hatch cover is in the closed position.

12. A railcar hatch cover adapted to be positioned relative to a longitudinally elongated hatch opening defined in a roof of a railroad hopper car, with said roof further including upstanding coaming arranged in surrounding relation relative to said hatch opening and provided with a rim arranged along a top edge thereof, and structure for mounting said hatch cover for movement between a closed position with respect to said hatch opening and an open position permitting access to the car through the hatch opening, said hatch cover comprising:

a laminate panel having longitudinal spaced ends and including an extruded inner member, an extruded outer member, and a solid plastic core material adhered to confronting surfaces of said inner and outer members, with said laminate panel having a center section and generally vertical sides, with one generally vertical side of said panel being disposed to each side of a longitudinal centerline of and extending between the ends of said panel and depending from said center section of said laminate panel, and wherein said laminate panel has a flexural rigidity S derived as follows:

$$S=E\times I$$

wherein "E" is the flexural modulus of the material and "I" is the Moment of Inertia of the hatch cover;

and wherein said laminate panel has an "E" value equal to $4\times10^6$ p.s.i.;

and wherein the cross-sectional configuration of the center section and two generally vertical sides of said laminate panel define a Moment of Inertia for said panel such that said laminate panel has a Stiffness equal to about $2.407\times10^7$ lbs.×inches$^2$;

compressible gasket structure secured to an underside of the center section of said laminate panel for engaging and pressing against the rim of said coaming to seal said hatch cover; and longitudinally spaced structure disposed inwardly from the opposed ends of and secured across the outer member of said laminate panel for adding strength and rigidity to the hatch cover.

13. The railcar hatch cover according to claim 12 wherein, said inner and said outer members of said laminate panel are extruded from aluminum and have a grain extending longitudinally of said laminate panel.

14. The railcar hatch cover according to claim 12 wherein, one generally vertical side of said laminate panel depends from said center section of said panel a greater distance than does the other generally vertical side of said laminate panel.

15. The railcar hatch cover according to claim 12 wherein the center section of said laminate panel has a vaulted formation to allow said hatch cover to shed water.

16. The railcar hatch cover according to claim 12 further including an end piece attached to and carried by each end of said laminate panel.

17. The railcar hatch cover according to claim 16 wherein said end piece includes a generally vertical wall section for inhibiting debris, dirt and other contaminants from moving therepast toward the gasket structure secured to the underside of the center section of said laminate panel.

18. The railcar hatch cover according to claim 16 wherein said end piece includes an upstanding ridge extending laterally across the end of the hatch cover, with said upstanding ridge being configured to cooperate with a batten bar to hold said hatch cover in the closed position.

19. The railcar hatch cover according to claim 18 wherein said batten bar has compressible gaskets structure nested therein for cooperatively combining with the raised ridge on said end cover when said hatch cover is in the closed position.

20. A railcar hatch cover adapted to be positioned relative to a longitudinally elongated hatch opening defined in a roof of a railroad hopper car, with said roof further including upstanding coaming arranged in surrounding relation relative to said hatch opening and provided with a rim arranged along a top edge thereof, and structure for mounting said hatch cover for movement between a closed position with respect to said hatch opening and an open position permitting access to the car through the hatch opening, said hatch cover comprising:

a rigid frame assembly comprised of a series of spaced and generally parallel metal support members, a pair of end pieces, and pair of longitudinally elongated rigid metal members extending substantially an entire length of the hatch cover, with said metal support members and said end pieces each having a center section with two laterally spaced end sections arranged in depending relation relative to said center section, and wherein the end sections of each support member and each end piece are fastened toward a distal end thereof to one of said rigid metal members; and a laminate panel of sufficient size to cover at least a longitudinal lengthwise portion of said hatch opening, said laminate panel having longitudinally spaced ends and including an inner aluminum member, an outer aluminum member, and a solid plastic core adhered to confronting surfaces of said inner and outer members, with a cross-section of said laminate panel including a center section with two generally vertical sides disposed to opposite sides of a longitudinal centerline of and extending between the ends of said panel and depending from said center section, and wherein said laminate panel is fastened to said frame assembly.

21. The railcar hatch cover according to claim 20 wherein, one generally vertical side of said laminate panel depends from said center section a greater distance than does the other generally vertical side of said laminate panel.

22. The railcar hatch cover according to claim 20 wherein the center section of said laminate panel has a vaulted formation to allow said hatch cover to shed water.

23. The railcar hatch cover according to claim 20 wherein said laminate panel has a flexural rigidity S derived as follows:

$$S=E\times I$$

wherein "E" is the flexural modulus of the material and "I" is the Moment of Inertia of the hatch cover;

and wherein said laminate panel has an "E" value equal to $4\times10^6$ p.s.i.;

and wherein the cross-sectional configuration of the center section and two sides of said laminate panel define a Moment of Inertia for said panel such that said laminate panel has a Stiffness equal to about $2.407\times10^7$ lbs.× inches$^2$.

24. The railcar hatch cover according to claim 20 wherein each generally vertical side of said laminate panel defines an angle ranging between 80° and about 115° relative to said center section and which is joined to the center section of the laminate panel along a longitudinally elongated curved corner section having a radius of less than about 1.5 inches.

* * * * *